US005168837A

United States Patent [19]

Scholz

[11] Patent Number: 5,168,837

[45] Date of Patent: Dec. 8, 1992

[54] MOTOR-DRIVEN WORK APPARATUS

[75] Inventor: Horst Scholz, Adelberg, Fed. Rep. of Germany

[73] Assignee: Andreas Stihl, Waiblingen, Fed. Rep. of Germany

[21] Appl. No.: 901,179

[22] Filed: Jun. 19, 1992

[30] Foreign Application Priority Data

Jun. 20, 1991 [DE] Fed. Rep. of Germany ..... 4120369

[51] Int. Cl.[5] ..... F01P 1/02

[52] U.S. Cl. ..... 123/41.7; 123/41.65

[58] Field of Search ..... 123/41.56, 41.65, 41.66, 123/41.7, 198 E

[56] References Cited

U.S. PATENT DOCUMENTS 4,970,993 11/1990 Weiss et al. ..... 123/41.7

*Primary Examiner*—Noah P. Kamen

*Attorney, Agent, or Firm*—Walter Ottesen

[57] ABSTRACT

The invention is directed to a work apparatus having a fan wheel driven by a motor mounted in a housing. A fan cover covers the fan wheel and defines a plurality of air-inlet openings arranged in a grid-like pattern forward of the fan wheel through which a first component flow of cooling air passes to the fan wheel. The fan cover has an inside wall surface and a collar formed on the inside wall surface. An air-conducting wall is mounted on the inside wall surface and defines cooling channels communicating with the space within the collar for conducting a second component flow of cooling air to the fan wheel. The fan cover and the collar together with the air-conducting wall conjointly define a single unitary piece devoid of any fasteners which are separate from the fan cover, collar and air-conducting wall.

10 Claims, 3 Drawing Sheets

MOTOR-DRIVEN WORK APPARATUS

FIELD OF THE INVENTION

The invention relates to a motor-driven work apparatus such as a chain saw, brushcutter, drill or the like which includes a fan wheel driven by an internal combustion engine. The intake region of the fan wheel is covered by a fan cover having a plurality of air-inlet openings arranged in a grid-like pattern. An air-conducting wall extending transversely to the axis of the fan wheel is disposed on the inside of the fan cover at a spacing from the latter. The air-conducting wall extends into an axially-directed collar for guiding the air into the pressure zone.

BACKGROUND OF THE INVENTION

In known work apparatus, the fan cover is releasably attached outside to the housing, for example, by means of screws so that the fan cover can be removed as required. On the inner side of the fan cover, an air-conducting wall is provided which is separate from the fan cover but is releasably connected thereto. This air-conducting wall extends into an axial collar which surrounds the fan wheel. The fan cover and the air-conducting wall having the axial collar are separate parts which are connected to each other by an insert connection and are tightly connected to each other with screws in order to avoid a loosening of the air-conducting wall as a consequence of engine vibrations or for other reasons. The fan cover and the air-conducting wall can then be removed together from the motor fan unit by releasing the attachment screws of the fan cover. A tight quiet seating of the air-conducting sheet metal in the fan cover is assured by the above-described connection between fan cover and air-conducting wall.

The known arrangement has a complex configuration since the fan cover and the air-conducting wall must be produced as separate parts and must be assembled to form one part while utilizing latching tongues and screws in order to avoid a loosening of the air-conducting wall under the vibration loads of the motor.

SUMMARY OF THE INVENTION

It is an object of the invention to provide a work apparatus having a fan cover so configured that the strength of the fan cover is improved, especially its resistance to bending and shock, while at the same time simplifying the structural configuration thereof. It is a further object of the invention to provide such a work apparatus wherein the complexity of the assembly of the fan cover and the air-conducting wall is simplified.

The work apparatus of the invention is a motor-driven work apparatus such as a chain saw, lawnmower or the like and includes: a motor housing; motor means mounted in the housing and having a drive shaft defining a shaft axis; a fan wheel defining an intake suction region and being mounted on the drive shaft for drawing cooling air through the intake suction region and into the housing for cooling the motor; a fan cover mounted on the housing and defining a plurality of air-inlet openings arranged in a grid-like pattern and disposed in the intake suction region for passing a first component flow of the cooling air to the fan wheel; the fan cover having an inside wall surface facing toward the fan wheel and having a collar formed on the inside wall surface; the collar being disposed in axial surrounding relationship to the fan wheel so as to delimit a space for the fan wheel; an air-conducting wall mounted on the inside wall surface and extending transversely to the axis to define channel means communicating with the space for conducting a second component flow of the cooling air to the fan wheel; and, the fan cover and the collar together with the air-conducting wall conjointly defining a single unitary piece devoid of any fastening means separate from the fan cover, collar and air-conducting wall.

It is advantageous to produce the fan cover and the air-conducting wall with its axial collar from one and the same light material such as plastic to achieve optimal stability and a simple and inexpensive manufacture thereof.

The arrangement is so configured that the air-conducting wall with its axial collar is connected with special legs to the ribs of the grid-like air-outlet openings of the fan cover. The air-conducting wall, the axial collar, the legs and the fan cover are all made of the same material. In a preferred embodiment, these connecting legs extend parallelly and transversely to the axis of the fan wheel and delimit separate air-conducting channels. In addition, the arrangement can be further configured so that the number of air-inlet openings provided on the forward side of the fan cover is increased by additional separate air-intake openings for the guide channel. When the air-intake openings of the guide channels are provided on a narrow edge of the fan cover, they define not only additional air-inlet openings for the intake air flow but also avoid an increase of the grid-like openings arranged on the forward side. Thus, the openings form additional air-intake openings which do not increase the surface of the fan cover.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
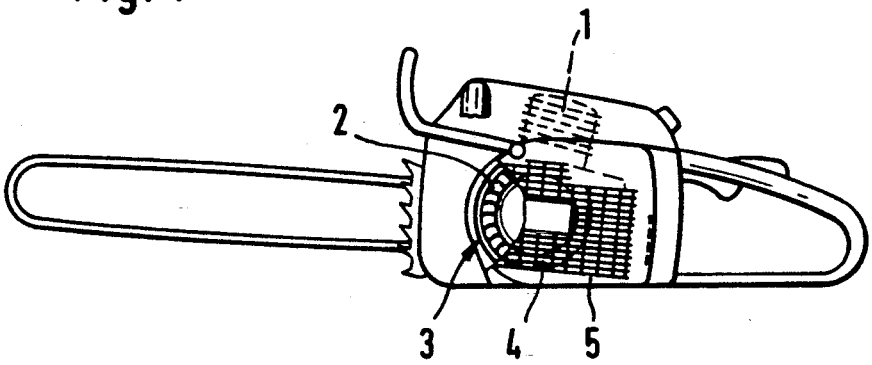
FIG. 1 is a side elevation view of a work apparatus in the form of a motor-driven chain saw with a front view of the fan cover.
Figure 2:
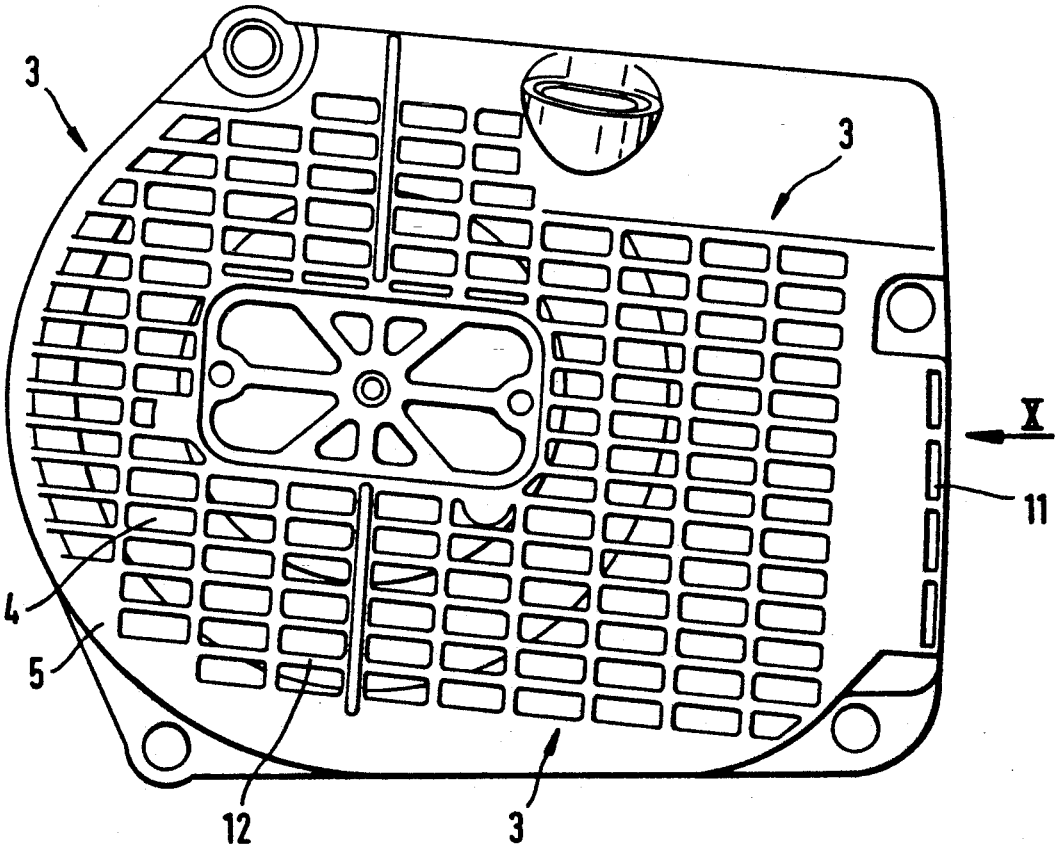
FIG. 2 is a view of the fan cover removed from the work apparatus showing the air-inlet openings arranged in a grid-like configuration.
Figure 3:
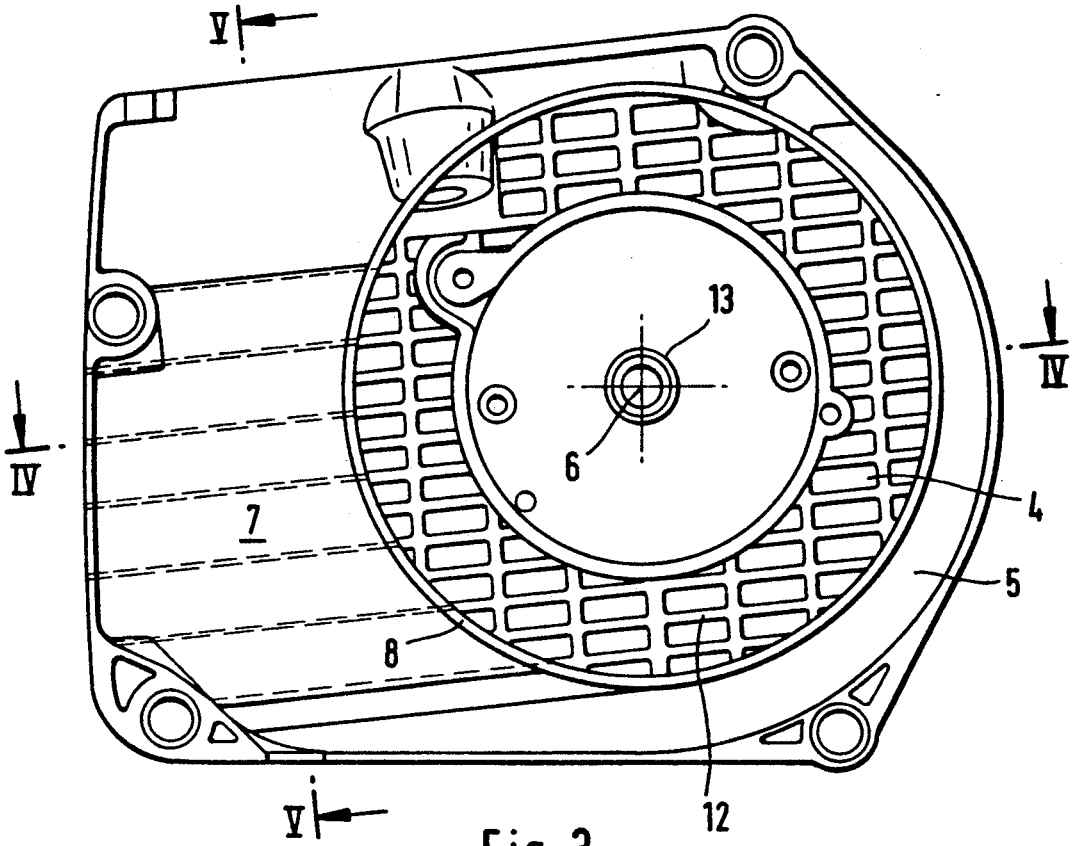
FIG. 3 is a plan view from within of the fan cover of FIG. 2.
Figure 5:
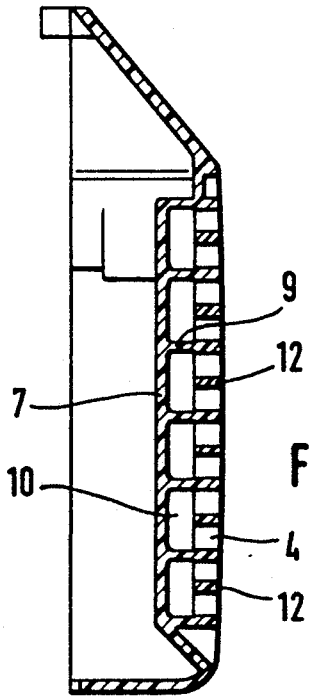
FIG. 5 is a section view taken along line V—V of FIG. 3.
Figure 6:
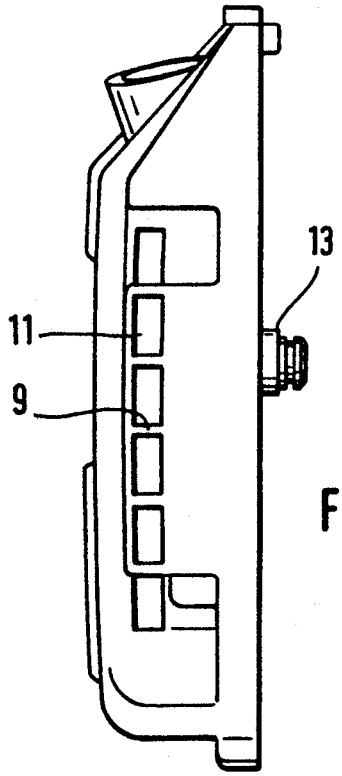
FIG. 6 is a view in the direction of arrow X shown in FIG. 2.
Figure 4:
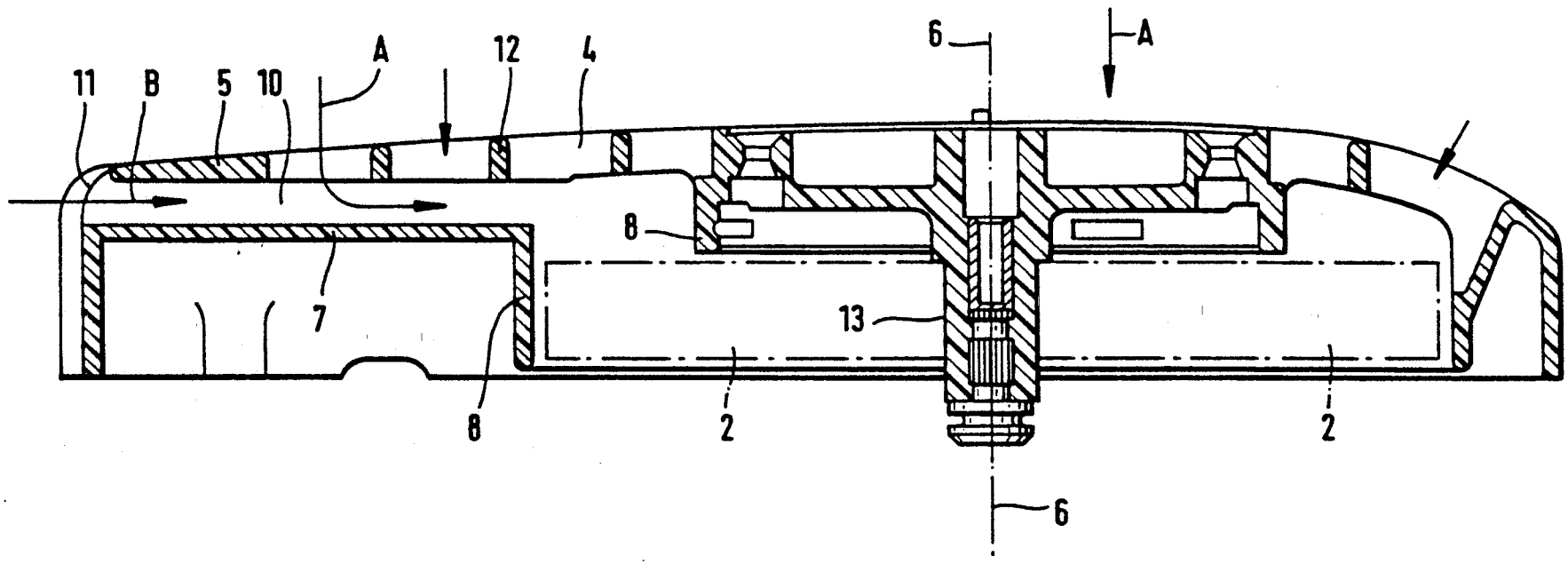
FIG. 4 is a somewhat enlarged section view taken along line IV—IV of FIG. 3.

FIG. 1 schematically shows a work apparatus in the form of a motor-driven chain saw driven by an internal combustion engine 1. A fan wheel 2 is seated on the crankshaft of the engine and has an intake region 3 covered by the fan cover 5. The fan cover 5 has a plurality of air-inlet openings 4 arranged in a grid-like configuration. The rope roll of the starter device is journalled for rotation about the axis 6 and is disposed within the fan cover 5. The fan wheel 2 is surrounded at least partially by an axial collar 8 which is configured with the air-conducting wall 7 as a single piece and which lies transversely to the fan wheel axis 6. The fan wheel draws the air in the direction of arrow A (FIG. 4)

through the air-inlet openings 4 with its rotation. Air is also drawn in at the lateral region of the fan cover where the air-conducting wall 7 runs at a spacing from the air-inlet openings 4. In this region, the air drawn in by suction is deflected by the air-conducting wall 7 in correspondence to the curved arrow A shown in FIG. 4 and flows together with the air drawn in around axis 6 into the axial collar 8 with increasing fan pressure and from there reaches the combustion cylinder.

The air-conducting wall 7 together with the axial collar 8 and the fan cover 5 conjointly define a single homogeneous component which has no attachment parts such as latching elements, screws or the like for holding the air-conducting wall 7 including the axial collar 8. Accordingly, the air-conducting wall 7 with the collar 8 defines a part made of a single material with the fan cover 5. This part is preferably produced from plastic by injection molding.

Connecting legs 9 are provided between the air-conducting wall 7 and the ribs 12 of the grid-like air-inlet openings 4 of the fan cover 5 in order to configure the fan cover 5 to be optimally stable against shock, vibrations or other loads. The connecting legs 9 are coincident with some of these ribs 12. The connecting legs 9 are not visible in plan view of the grid structure of the intake region 3 of the fan wheel. The connecting legs 9 do not constitute a disturbance either with respect to flow or optically.

Because the connecting legs 9 extend coincidentally with a portion of the ribs 12 and continue to the air-conducting wall 7, they at the same time define a stable connection between the grid structure of the fan cover 5 and the air-conducting wall 7 lying therebehind in flow direction. The connecting legs 9 are mutually parallel and extend transversely to the shaft 6 of the fan wheel 2. For this reason, air-conducting channels 10 are formed having air-intake openings 11 through which cooling air (see arrow B in FIG. 4) is drawn in by suction in addition to the inflowing air flowing in the direction of arrows A.

The air-inlet openings 11 of the air-conducting channels 10 are disposed outside of the region of the air-inlet openings 4 and lie in a single plane together with the air-inlet channels 10. This plane is disposed behind the air-inlet openings 4 and lies transversely to the fan axis 6 so that intake air can flow in via the air-inlet openings 11 located there in addition to the air-inlet openings 4 at the front side of the fan cover 5.

In the embodiment shown, a total of six additional air-conducting channels 10 are provided with their air-intake openings 11 disposed at the narrow end of the fan cover 5 with the air-conducting channels 10 lying parallel to each other. The connecting legs 9 delimiting the air channels 10 lie conveniently with respect to flow within the projection of the corresponding parallel grid ribs 12 of the air-inlet openings 4 in that they are configured in a simple manner as extensions of these grid ribs 12.

A bearing 13 for the pull-rope starter device is arranged on the inner side of the fan cover 5 in a manner known per se. The bearing 13 also forms a homogeneous component with the fan cover 5. The air-conducting wall 7 and the connecting legs 9 to the air-inlet openings 4 are produced utilizing transverse elements (not shown) extending transversely to the axis 6 of the fan wheel 2.

The invention provides a very stable fan cover having additional air-inlet openings for increasing the air-intake volume without the fan cover itself or the front intake region thereof having to be increased. In addition to the improvement of the stability of the overall fan cover, the fan cover is greatly simplified with respect to its manufacture because the separate configuration of the air-conducting wall and/or its axial collar no longer has to be assembled together. In addition to reducing assembly time, the connecting elements between these parts which were previously necessary, namely, the latch tongues and the latch openings corresponding thereto as well as separate attachment screws are no longer necessary.

It is understood that the foregoing description is that of the preferred embodiments of the invention and that various changes and modifications may be made thereto without departing from the spirit and scope of the invention as defined in the appended claims.

What is claimed is:

1. A motor-driven work apparatus such as a chain saw, lawnmower or the like, the work apparatus comprising:

a motor housing;

motor means mounted in said housing and having a drive shaft defining a shaft axis;

a fan wheel defining an intake suction region and being mounted on said drive shaft for drawing cooling air through said intake suction region and into said housing for cooling said motor;

a fan cover mounted on said housing and defining a plurality of air-inlet openings arranged in a grid-like pattern and disposed in said intake suction region for passing a first component flow of said cooling air to said fan wheel;

said fan cover having an inside wall surface facing toward said fan wheel and having a collar formed on said inside wall surface;

said collar being disposed in axial surrounding relationship to said fan wheel so as to delimit a space for said fan wheel;

an air-conducting wall mounted on said inside wall surface and extending transversely to said axis to define channel means communicating with said space for conducting a second component flow of said cooling air to said fan wheel; and, said fan cover and said collar together with said air-conducting wall conjointly defining a single unitary piece devoid of any fastening means separate from said fan cover, collar and air-conducting wall.

2. The motor-driven work apparatus of claim 1, said fan cover with said collar being produced of one and the same light material.

3. The motor-driven work apparatus of claim 2, said light material being plastic.

4. The motor-driven work apparatus of claim 1, said fan cover having a plurality of ribs formed on said inside wall surface defining said air-inlet openings; and, said air-conducting wall including a plurality of connecting legs joined to selected ones of said ribs so as to be made of the same material as said ribs and unitary therewith.

5. The motor-driven work apparatus of claim 4, said connecting legs being mutually parallel and delimiting air-conducting channels running transversely to said axis.

6. The motor-driven work apparatus of claim 5, said air-inlet openings being a first plurality of openings and said fan cover having a second plurality of openings formed in said fan cover so as to communicate with said air-conducting channels; and, said second plurality of openings being at a location on said fan cover remote from said intake suction region for passing at least a portion of said second component flow to said air-conducting channels.

7. The motor-driven work apparatus of claim 6, said fan cover having a narrow edge formed at said location and said second plurality of openings being formed in said narrow edge.

8. The motor-driven work apparatus of claim 4, said selected ones of said ribs being parallel to each other and said connecting legs being respective extensions of said selected ones of said ribs when said fan cover is viewed in plan.

9. The motor-driven work apparatus of claim 1, said motor being an internal combustion engine; said fan cover having a bearing pin formed on said inside wall surface for accommodating a pull-robe starter device; and, said bearing pin being an integral part of said fan cover.

10. The motor-driven work apparatus of claim 1, said fan cover and said air-conducting wall conjointly defining an inseparable connection to said collar.

* * * * *